US007694351B2

(12) United States Patent
Gait

(10) Patent No.: US 7,694,351 B2
(45) Date of Patent: Apr. 13, 2010

(54) SPORTS GLOVE WITH A SEGMENTED JOINT PROTECTOR

(75) Inventor: Paul Gait, Altamont, NY (US)

(73) Assignee: Rawlings Sporting Goods Company, Inc., St. Louis, MO (US)

( * ) Notice: Subject to any disclaimer, the term of this patent is extended or adjusted under 35 U.S.C. 154(b) by 239 days.

(21) Appl. No.: 11/754,239

(22) Filed: May 25, 2007

(65) Prior Publication Data

US 2007/0261149 A1 Nov. 15, 2007

Related U.S. Application Data

(63) Continuation of application No. 10/889,836, filed on Jul. 13, 2004, now Pat. No. 7,275,268.

(51) Int. Cl.
*A41D 19/00* (2006.01)

(52) U.S. Cl. ..... 2/161.1; 2/163

(58) Field of Classification Search ..... 2/16, 2/20, 21, 161.1, 163
See application file for complete search history.

(56) References Cited

U.S. PATENT DOCUMENTS 3,882,548 A * 5/1975 Shinagawa et al. ..... 2/20
3,911,497 A 10/1975 Lewis, Jr.
4,027,339 A 6/1977 Brucker
4,137,572 A 2/1979 Jansson et al.
D257,909 S 1/1981 Brine
4,272,850 A 6/1981 Rule
4,497,073 A 2/1985 Deutsch
4,524,464 A 6/1985 Primiano
4,570,269 A * 2/1986 Berlese ..... 2/16
4,677,698 A 7/1987 Angas
4,815,147 A 3/1989 Gazzano
4,930,162 A 6/1990 Cote
5,031,240 A 7/1991 Nierhaus
5,237,703 A 8/1993 Brine
5,345,609 A * 9/1994 Fabry et al. ..... 2/20
5,367,712 A 11/1994 Smith
5,488,739 A 2/1996 Cardinal
5,511,242 A 4/1996 Bianchi
5,511,243 A 4/1996 Hall
5,745,916 A 5/1998 Linner
5,819,312 A 10/1998 Snyder
5,884,329 A 3/1999 Goldsmith
5,946,720 A 9/1999 Sauriol
5,963,985 A 10/1999 Behr (Continued)

FOREIGN PATENT DOCUMENTS

CA 1222853 6/1987

*Primary Examiner*—Katherine Moran
(74) *Attorney, Agent, or Firm*—Waddey & Patterson, P.C.; Phillip E. Walker

(57) ABSTRACT

A sports glove comprising a dorsal side and at least one joint protector. The dorsal side provides a plurality of protection sections and the joint protectors positioned between the plurality of protection sections. The joint protector includes a base operatively attached to the dorsal side and a plurality of extended members attached to the base and projecting from the base. The joint protector substantially fills any apertures created in the sports glove by a user of the glove during participation in sports. The extended members of the joint protector deflect independently of the protection sections and can be biased toward the protection sections to substantially fill any apertures between the protection sections.

18 Claims, 7 Drawing Sheets

U.S. PATENT DOCUMENTS

| | | | | |
|---|---|---|---|---|
| 5,983,396 | A | 11/1999 | Morrow | |
| 5,996,117 | A | 12/1999 | Goldsmith | |
| 6,085,354 | A | 7/2000 | Wilder et al. | |
| 6,122,769 | A | 9/2000 | Wilder et al. | |
| 6,226,795 | B1 | 5/2001 | Winningham | |
| 6,233,744 | B1 | 5/2001 | McDuff | |
| 6,256,792 | B1 | 7/2001 | MacDonald | |
| D446,888 | S | 8/2001 | Morrow | |
| D462,146 | S | 8/2002 | Aoki | |
| 6,543,057 | B2 | 4/2003 | Beland | |
| 6,550,069 | B1 | 4/2003 | Morrow | |
| 6,643,844 | B2 | 11/2003 | Morrow | |
| 6,715,152 | B2 | 4/2004 | Mazzarolo | |
| 6,725,466 | B2 | 4/2004 | Hochmuth | |
| 7,275,268 | B2 * | 10/2007 | Gait | 2/161.1 |
| 2002/0069445 | A1 | 6/2002 | Beland | |
| 2003/0014805 | A1 | 1/2003 | Morrow | |
| 2003/0101504 | A1 | 6/2003 | Morrow | |
| 2003/0106131 | A1 | 6/2003 | Tremblay | |
| 2003/0163862 | A1 | 9/2003 | Hoffman | |
| 2003/0218344 | A1 | 11/2003 | Garrett | |
| 2004/0226074 | A1 | 11/2004 | Taira et al. | |
| 2005/0066411 | A1 | 3/2005 | Matechen | |

* cited by examiner

SPORTS GLOVE WITH A SEGMENTED JOINT PROTECTOR

This application is a continuation application of co-pending U.S. application Ser. No. 10/889,836 filed Jul. 13, 2004 entitled "Sports Glove With A Segmented Joint Protector", which is hereby incorporated by reference in its entirety.

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

BACKGROUND OF THE INVENTION

This invention relates generally to protective gloves. More particularly, this invention relates to protective sports gloves having a joint protector to provide protection for the knuckles of the hand of the wearer of the glove.

In many contact sports, it is essential to intentionally strike the participants of the sport. Depending on the given sport, certain body parts are under greater exposure and stress than others. For example, in sports such as Lacrosse, hockey, and other sports in which a stick type object is an essential part of the game, a participant's hands are exposed to a large amount of contact and as such it is important to protect those hands during the course of play of the sport. It is also important to maintain a high level flexibility in the participant's hands in order to adequately participate in the sport. As such, a protective glove in sports should both protect and retain flexibility.

Various protective sporting gloves have been developed over the years for use in lacrosse, hockey, and other similar contact sports. These gloves are designed protect the user of the glove, or player of the sport, against impacts and blows to their hands during participation in the sporting event. Unfortunately, as the protection provided by these gloves increases, the user of these prior art gloves experiences a reduction in the amount of flexibility he has in his hand due to the configuration of the glove. This reduction in flexibility can substantially reduce the effectiveness and level of play of a participant wearing the glove. Traditionally, however, as the level of flexibility allowed by a protective glove would remain high, the protection provided by that glove would be limited.

There are several areas of the hand that need to maintain an increased level of flexibility and yet still need a high level of protection. These areas include the various joints of the fingers and hand including the knuckles. For example, the knuckle joints of a participant's hand need to maintain as close to the full range of flexibility as possible in order to properly grip the equipment used during the sport, and sometimes the other participants in the sport.

Traditionally, compounding this issue is the very padding located at the knuckle areas. In order to sustain as complete of a range of motion as possible for the fingers of the hand, the padding or protection on the fingers should not substantially restrict the flexibility of the finger. Otherwise, the amount of the rotational range in the fingers of the hand when flexed will be limited due to the increased padding and protective materials in the glove.

For example, as the fingers move from an extend position to a curled position, padding located on the back of the glove above a knuckle will move from being adjacent to one another to create a gap of over ninety degrees. As such, additional protection is needed to fill this gap. However, when the additional protection was added, the additional protection reduced the range of movement of the fingers, especially when attempting to extend the fingers Most of the prior art has used segmented padding pieces in order to attempt to both protect the hand of the participant and maintain flexibility. For example, U.S. Pat. No. 4,027,339, U.S. Pat. No. 4,137,572, U.S. Pat. No. 5,511,242, U.S. Pat. No. 5,745,916, U.S. Pat. No. 5,946,720, U.S. Pat. No. 6,085,354, U.S. Pat. No. 6,122,769, U.S. Pat. No. 6,543,057, U.S. Pat. No. 6,550,069, and U.S. Pat. No. 6,643,844, all disclose various sports gloves having segmented padding sections. Some of these prior art gloves have attempted to specifically protect the knuckles of a participant while maintaining flexibility. However, these prior art attempts have either tried to create overlapping padding, add a piece of soft cloth material to cover the gaps between the padding where the piece spans from one padding section to another or used cloth material folded and placed within the padding joint.

What is needed then is a joint protector for a sports glove that provides improved protection of the joints of the hand while maintaining flexibility at those joints for the wearer of the glove as the wearer participates in the sport. A glove containing this protective joint is lacking in the prior art.

BRIEF SUMMARY OF THE INVENTION

Included herein is a sports glove comprising a dorsal side and at least one joint protector. The dorsal side provides a plurality of protection sections wherein the joint protectors are positioned between the plurality of protection sections. The joint protector includes a base operatively attached to the dorsal side and at least one extended member attached to the base and projecting from the base. The joint protector substantially fills any apertures created in the sports glove by a user of the glove during participation in sports. The extended members of the joint protector deflect independently of the protection sections and can be biased toward the protection sections to substantially fill any apertures between the protection sections.

In a preferred embodiment, at least one of the extended members is hinged to the base and biased towards the adjacent protection section. In this preferred embodiment there is a first extended member, second extended member, and a middle extended member where the first and second extended members are biased away from the middle extended member towards the adjacent protection sections. In this embodiment the base includes a groove positioned proximate to the attachment of the extended members and the base to bias the first and second extended members.

It is therefore the general object of the current invention to provide a protective sports glove.

It is another object of the current invention to provide a sports glove having a joint protector.

It is still another object of the present invention to provide a sports glove having a joint protector to protect the knuckles of a wearer of the glove.

It is still another object of the present invention is to provide a sports glove having at least one joint protector positioned in between protection sections of the glove such that the joint protector protects any gaps between the padding sections.

And yet still another object of the present invention is to provide a joint protector having a base and at least one extended member attached to the base where the extended members are independently biased in order to fill any aperture between padding sections of a glove.

Other further objects and features will be readily apparent to one skilled in the art upon a reading of the following description and a review of the attached Figures.

BRIEF DESCRIPTION OF THE SEVERAL VIEWS OF THE DRAWINGS

FIG. 2 shows the fingers of the glove extended.

FIG. 5A shows the finger in an extended position.

DETAILED DESCRIPTION OF THE PREFERRED EMBODIMENTS

Figure 1:
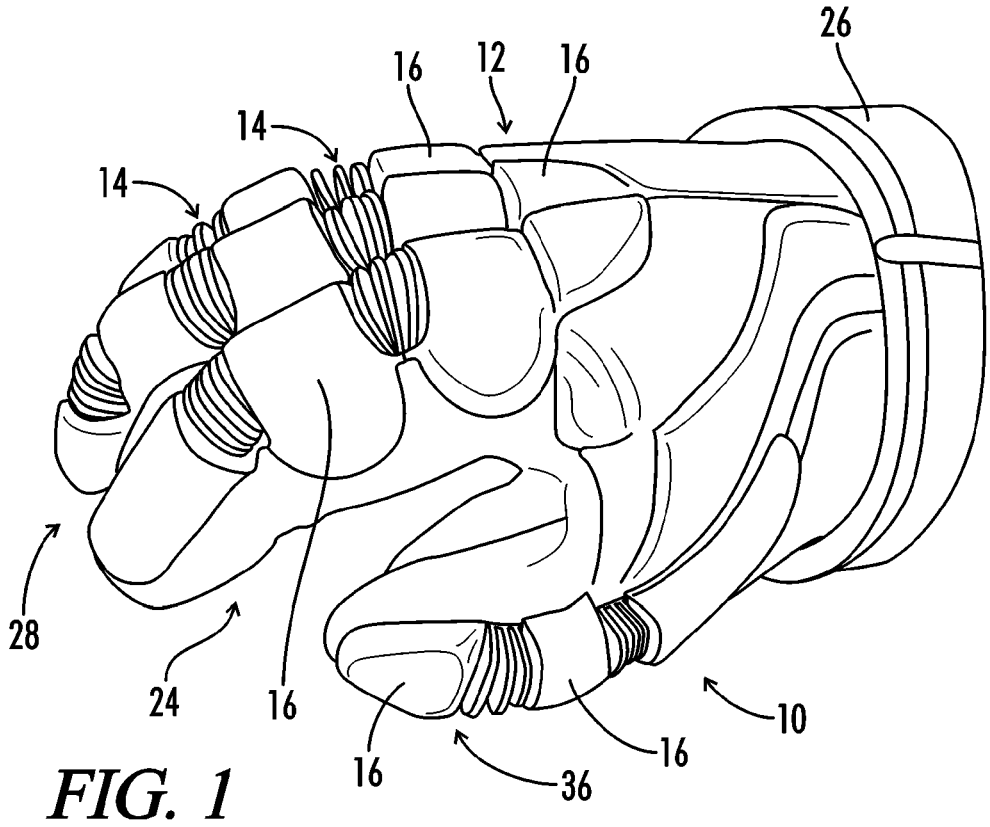
FIG. 1 is a side perspective view of one embodiment of a sports glove made in accordance with the current invention.

Referring generally now to FIGS. 1-12, a sports glove made in accordance with the current invention is shown and generally designated by the numeral 10. The sports glove (10) can be used to protect the hand (not shown) of a participant of a contact sporting event, such as Lacrosse, hockey, and the like. The sports glove comprises a dorsal side (12) and at least one joint protector (14). The dorsal side (12) includes a plurality of protection sections (16) positioned to protect the hand of a participant. Each joint protector (14) is positioned between two protection sections (16) in order to protect a joint (18) on the hand of a participant. For example, the joint (18) can be any knuckle on the finger (19) of a participant.

The joint protector (14) includes a base (20) operatively attached to the dorsal side (12) of the sports glove (10). The joint protector (14) also includes at least one extended member (22) attached to the base (20) and projecting from the base (20).

The sports glove (10) also includes a palm side (24), a cuff section (26) and five finger cases (28-36), which can also be described as finger sheaths (28-36). The protection section (16), which can also be described as padding (16) can be positioned on the dorsal side (12), which can also be described as a back side (12), in various configurations in order to adequately protect the hand and fingers (19) of a wearer of the sports glove (10) as he/she participates in an event.

Figure 2:
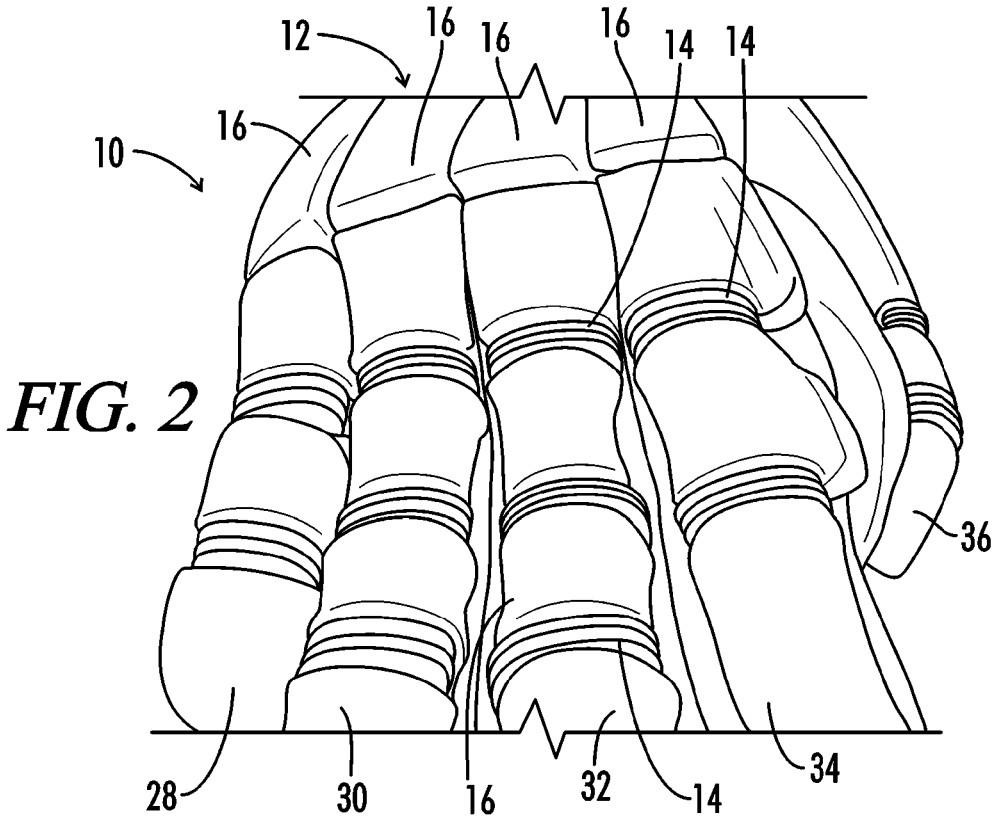
FIG. 2 is a top view of the sports glove show in FIG. 1.
Figure 3:
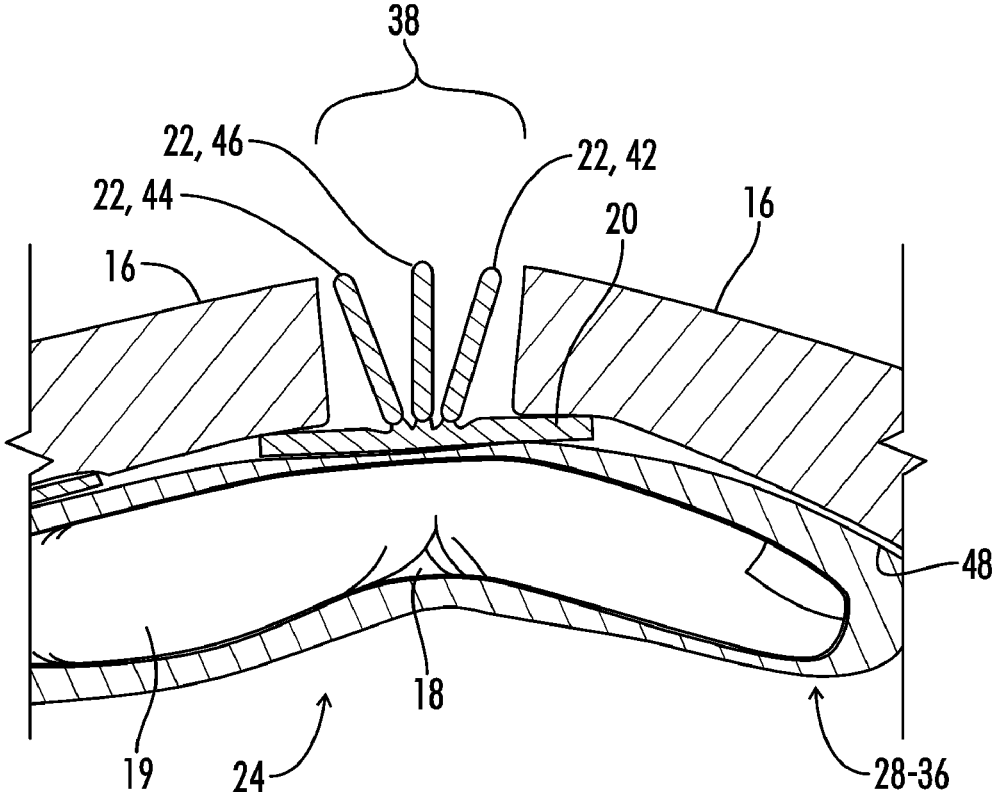
FIG. 3 shows a sectional view of one finger of a sports glove containing a joint protector made in accordance with the current invention.
Figure 4:
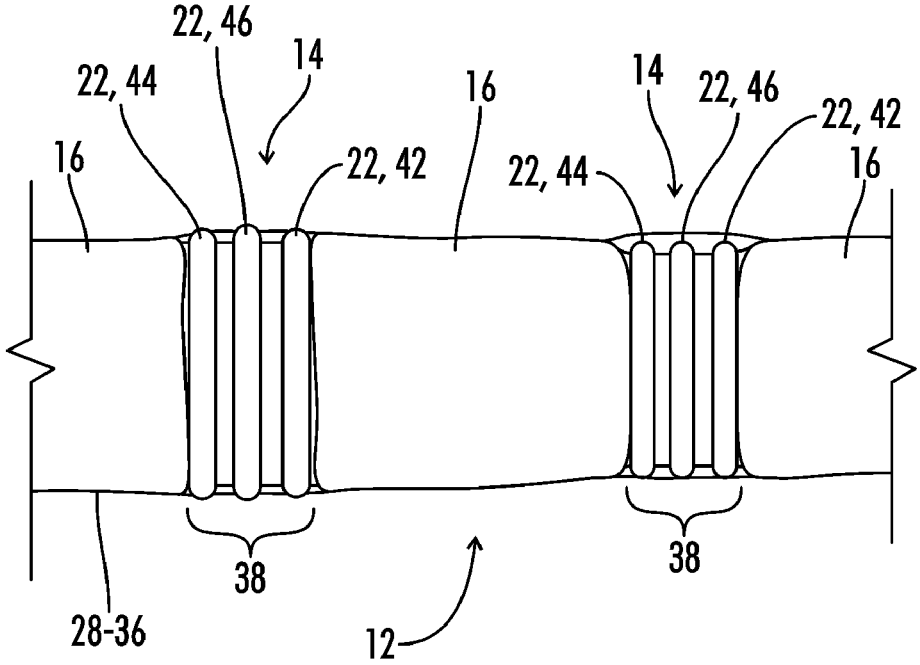
FIG. 4 shows a top view of a finger of an embodiment of a sports glove made in accordance with the current invention.
Figure 5A:
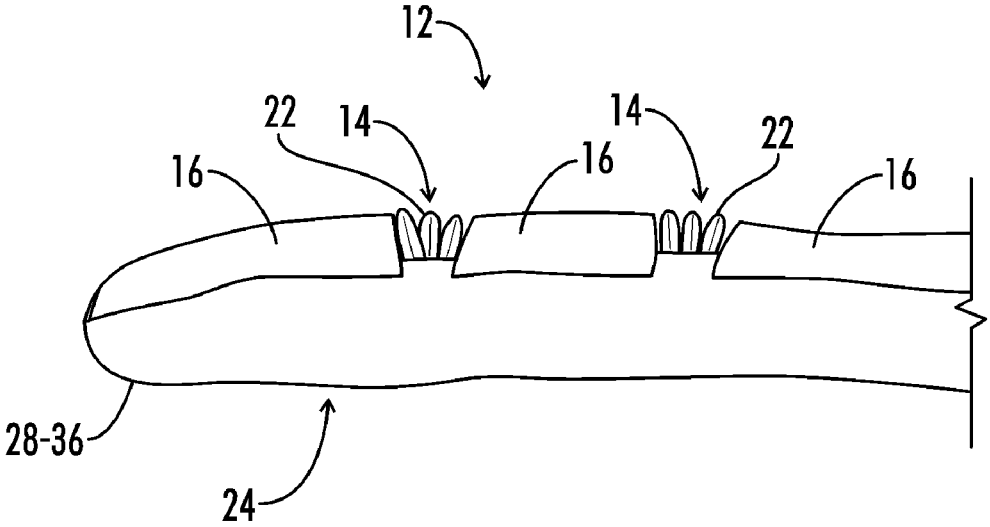
FIG. 5A shows a finger of a sports glove made in accordance with the current invention.
Figure 5B:
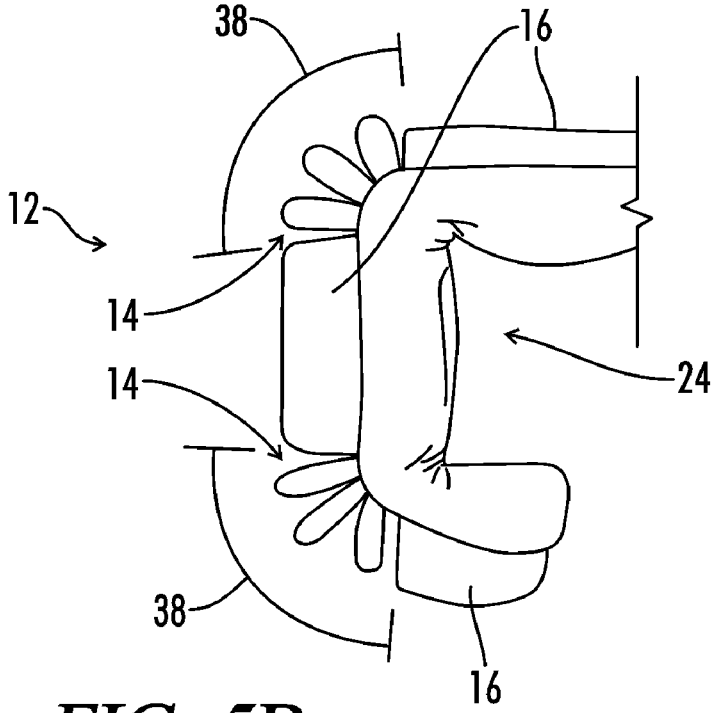
FIG. 5B shows the finger of 5A in a bent, or curled, position.

The joint protector (14), which can also be described as a knuckle guard (14), has many advantageous characteristics. For example, the joint protectors (14) are preferably malleable in order to expand and retract as need be substantially fill the aperture (38) located between adjacent protection sections (16). This is best illustrated when comparing FIGS. 1 and 2 and FIGS. 5A and 5B. FIGS. 2 and 5A show an extension of one of the finger sheath (28-36), which can also be described as a finger sleeves (28-36), in an extended position showing the joint protector (14) in a retract or a compact position. FIGS. 1 and 5B show the ability of the joint protector (14) to expand with the contraction of one of the finger cases (28-36). The contraction, or curling, of a finger case (28-36) causes the aperture (38), which can also be described as a gap (38), between the padding sections (16) to increase in size. The positioning of the joint protector (14) and its ability to expand to substantially fill this aperture (38) protects the knuckle (18), or joint (18), on the hand of a wearer.

In a preferred embodiment at least one of the extended members (22) is hinged to the base (20). This hinged attachment allows the deflection of the extended members (22) with respect to the base (20). The hinged attachment is preferably accomplished through a neck attachment (40) between the extended members (22) and the base (20). The neck attachment (40) provides a flexible attachment which allows movement of the extended members (22) relative to the base (20).

The plurality of extended members (22) includes a first extended member (42), a second extended member (44) and a middle extended member (46). The first and second extended members (42) and (44) are biased away from the middle extended member (46). This can also be described as the first and second extended members (42) and (44) are biased towards the adjacent protection section (16). The base (20) includes a groove (21) positioned near the neck attachment (40) to bias the first and second extended members (42) and (44). The positioning of the groove (21) on the base (20) can also be described as a live hinge, or a living hinge. The groove (21) can also be described as a crease (21) or a notch (21).

Preferably, both the first extended member (42) and the second extended member (44) include a groove (21) that biases the first extended member (42) away from the second extended member (44) and the second extended member (44) away from the first extended member (42). This bias can be described as purposely deflecting the extended members (22).

Additionally, the extended members (22) can deflect independently of the protection section (16). This is due in part to the independent attachment of the extended members (22) and the protection section (16).

Figure 11:
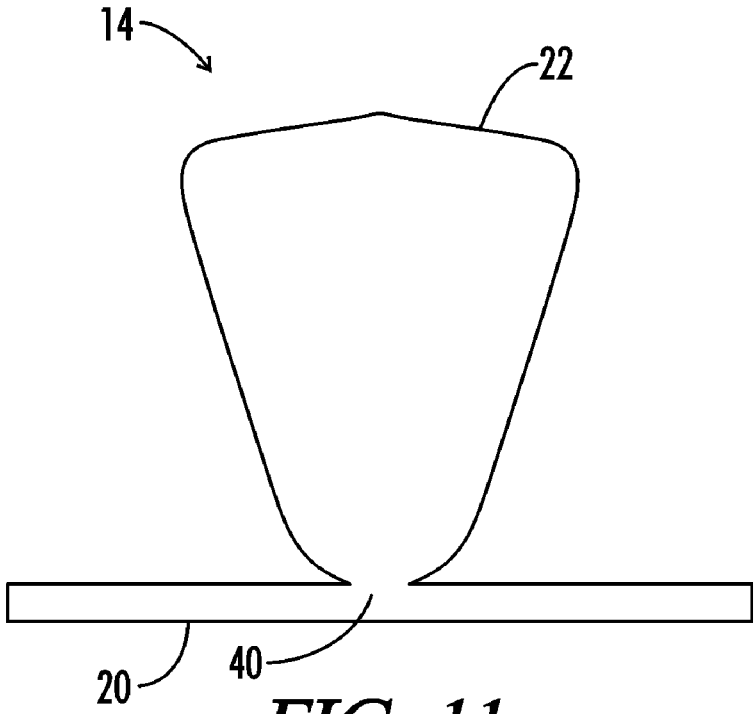
FIG. 11 shows the top view of an alternate embodiment of a joint protector made in accordance with the current invention.
Figure 12:
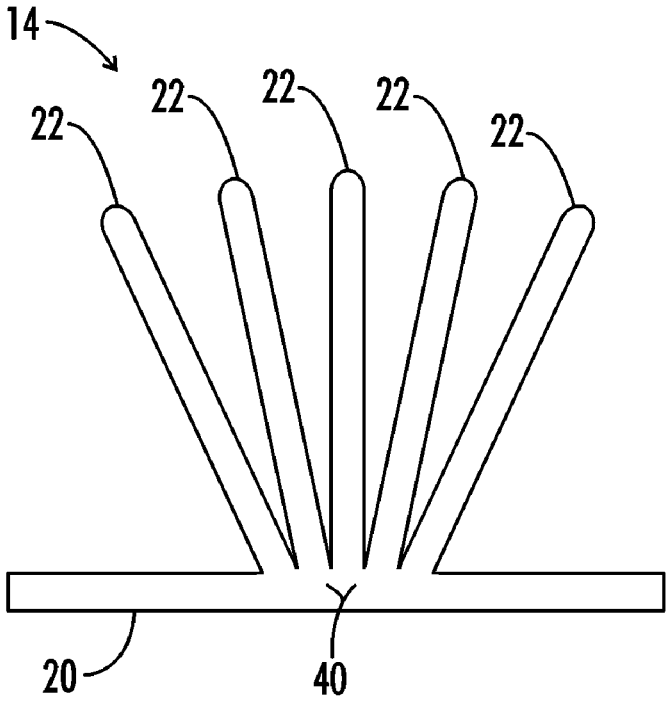
FIG. 12 shows the top view of another alternate embodiment of a joint protector made in accordance with the current invention.

In alternate embodiments, as shown in FIGS. 11 and 12, the joint protector (14) can include a single extended member (22) or can various numbers of extended members (22) that provide the independent joint protection of the current invention.

In a preferred embodiment the joint protectors (14) are sewn onto the lining (48) positioned under the protection sections (16). However, the joint protectors (14) can be attached by other techniques known in the art including, but not limited to, Velcro, adhesives, thermal binding, etc.

Due to the inventive structure, the flexibility of the joint protector (14), and specifically the extended members (22), is not dependent upon the material in which the extended members (22) comprise. Instead, the flexibility can be maintained substantially independently of the density and type of material that the joint protector (14) comprises.

As such, the protection for the joint (18) of the hand of a wearer of the sports glove (10) can be substantially increased by the use of harder materials, such as hard plastic and other hard polymers, without sacrificing the flexibility within the joint area of the sports glove (10). As such, the joint protector (14) can be made of hard material, semi-flexible material and the like in order to protect the joint (18) without sacrificing flexibility.

Additionally, due to the independent deflection of the extended members (22) in relationship to the protection section (16), greater protection of the joint (18) can be realized. This increased protection and flexibility can also be attributed to the fact that the extended members (22) are independent of one another distal from their attachment to the base (20). This remote independence allows selective deflection and movement of the extended members (22) to allow the extended members (22) to substantially fill the aperture (38) and protect the joint (18).

The extended members (22) can also be described as flange members (22) wherein the flange members (22) are operatively attached to and projecting from the backside (12) of the finger cases (28-36). In a preferred embodiment there are at least three padding sections (16) and at least two knuckle protectors (14) on each finger case (28-36).

The first extended member (42) can also be described as a fore flange member (42). The second extended member (44) can also be described as a rear flange member (44). The middle extended member (46) can also be described as a middle flange member (46).

Figure 6A:
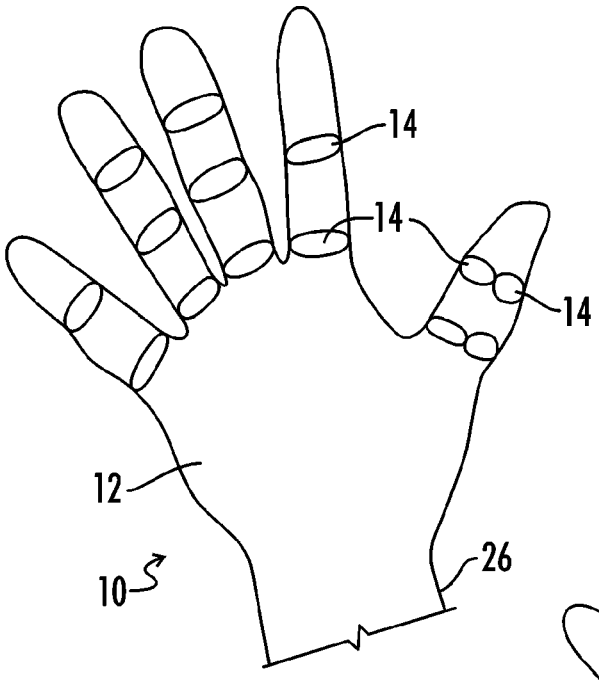
FIG. 6A shows a schematic of a preferred embodiment of the sports glove indicating a preferred location of the joint protectors on a sports glove.
Figure 6B:
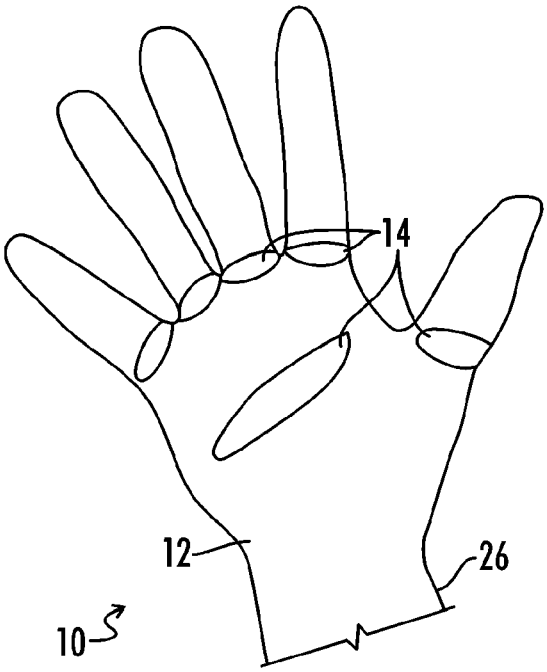
FIG. 6B shows a schematic of an alternate embodiment of the sports glove indicating additional possible locations of the joint protectors on a sports glove.
Figure 6C:
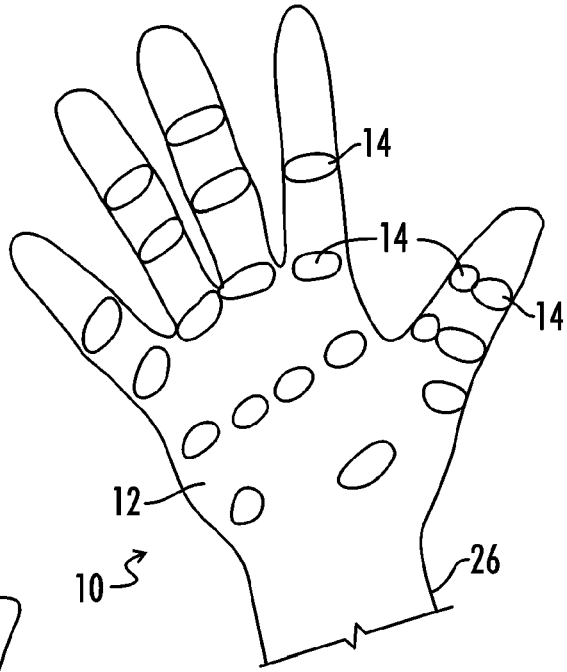
FIG. 6C shows a schematic of another alternate embodiment of the sports glove indicating additional possible locations of the joint protectors on a sports glove.
Figure 7:
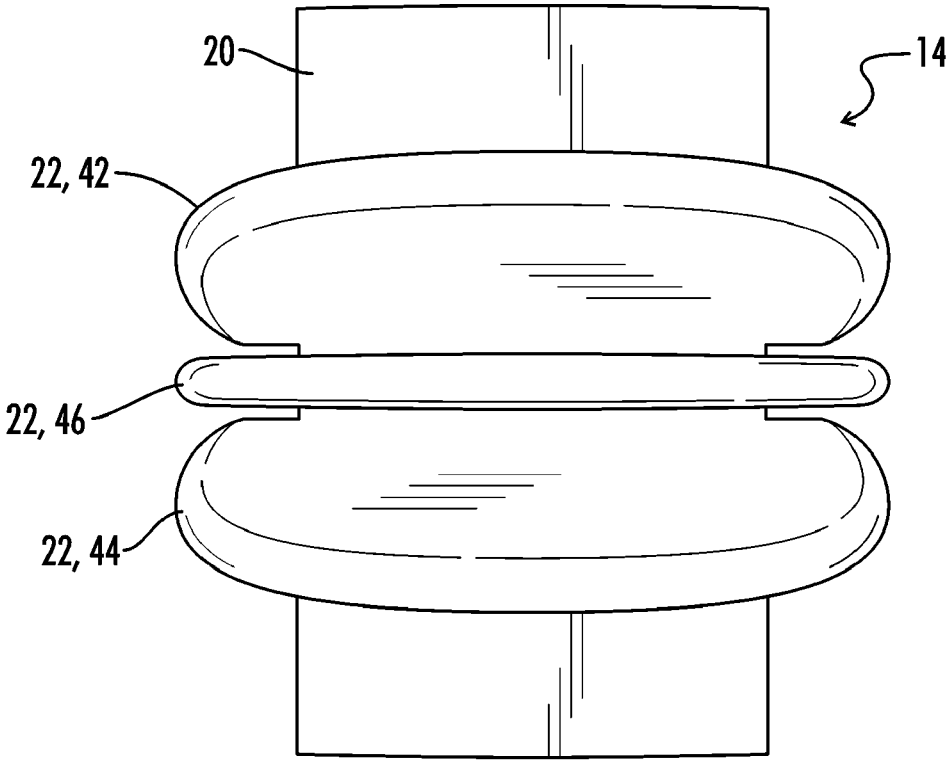
FIG. 7 shows the top view of a preferred joint protector made in accordance with the current invention.
Figure 8:
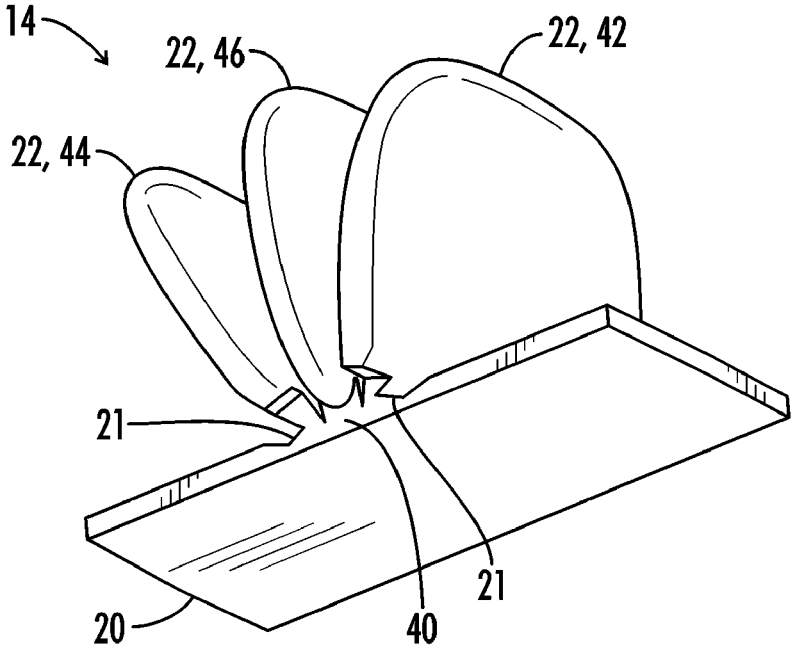
FIG. 8 shows a bottom perspective view of the joint protector shown in FIG. 7.
Figure 9:
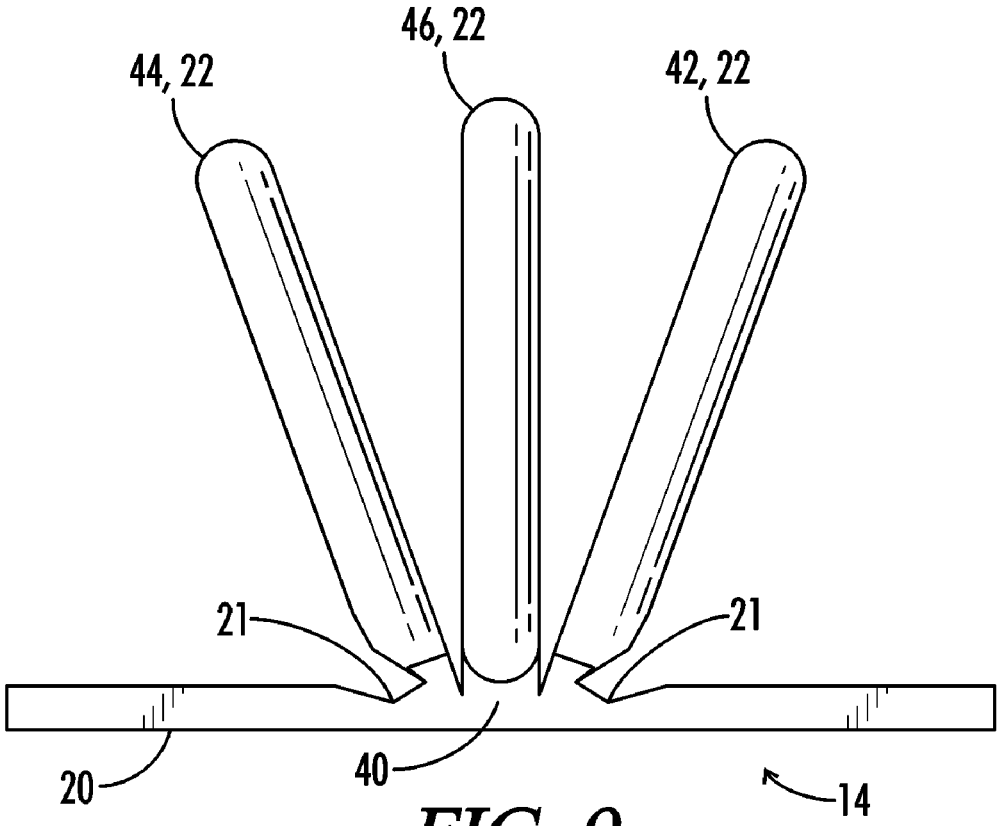
FIG. 9 shows a side view of the joint protector shown in FIGS. 7 and 8.
Figure 10:
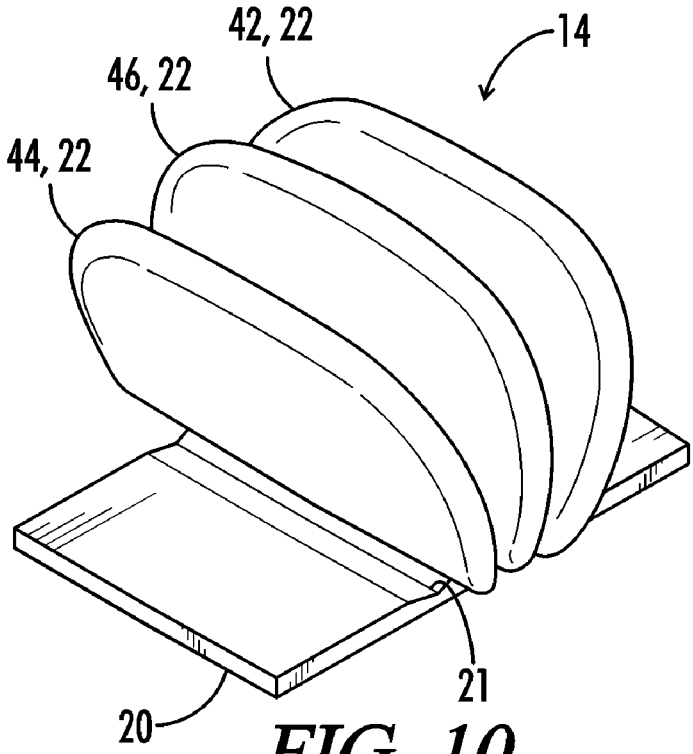
FIG. 10 shows a top perspective view of the joint protector shown in FIGS. 7-9.

In a most preferred embodiment the thumb section (36) includes two joint protectors (14) at each joint (18). Additionally, the finger cases (32 and 34) corresponding to the middle fingers of a hand of a wearer include three joint protectors (14) located along the length of the finger, with one joint protector (14) located at each joint (18), as schematically shown in FIG. 6.

The first extended member (42) and the second extended member (44) are attached to the base (20) at an angle in order to further facilitate the positioning of the extended members (22) to fill the gap (38) as the finger cases (28) curl. The actual angle of attachment of the extended members to the base may vary depending on the range of opening of the joint. However, in a preferred embodiment, the angle of the first and second extended members (42 and 44) is approximately 30 degrees from the middle extended member (46).

Thus, although there have been described particular embodiments of the present invention of a new and useful Sports Glove With A Segmented Joint Protector, it is not intended that such references be construed as limitations upon the scope of this invention except as set forth in the following claims.

What is claimed is:

1. A sports glove comprising:

a dorsal side including a plurality of protection sections;

a joint protector positioned between the plurality of protection sections and including a base operatively attached to the dorsal side and at least one extended member attached to the base and projecting from the base, the at least one extended member spaced from the protection sections and attached to the base independent of the protection sections; and further including a neck attachment between the at least one extended member and the base, the neck attachment flexibly attaching the at least one extended member and the base.

2. The sports glove of claim 1, wherein the extended member is hinged to the base.

3. The sports glove of claim 1, wherein the at least one extended member includes a first extended member, a second extended member, and a middle extended member.

4. The sports glove of claim 1, wherein the at least one extended member is spaced from the adjacent protection sections.

5. The sports glove of claim 1, wherein the base is partially positioned under one of the protection sections.

6. The sports glove of claim 1, wherein the joint protector flexes independent of the plurality of protection sections.

7. The sports glove of claim 1, wherein the joint protector is comprised of hard material.

8. The sports glove of claim 1, wherein the joint protector is comprised of semi-flexible material.

9. The sports glove of claim 1, wherein the joint protector is molded.

10. The sports glove of claim 1, wherein the joint protector is plastic.

11. The sports glove of claim 1, wherein the at least one extended member can deflect independent of the protection section.

12. The sports glove of claim 1, wherein the at least one extended member is independent distal from the attachment to the base.

13. The sports glove of claim 1, further including an aperture defined between two of the protection sections and the joint protector substantially fills the aperture during use of the sports glove by a user.

14. A sports glove comprising:

a plurality of finger cases, each finger case including:

a back side having a plurality of padding sections; and a knuckle guard separately positioned between each padding section and separating adjacent padding sections, the knuckle guard including a base attached to the back side and at least one flange member operatively attached to and projecting from the base, the knuckle guard including a fore flange member, a middle flange member, and a rear flange member.

15. The sports glove of claim 14, wherein each finger case includes at least three padding sections and at least two knuckle protectors.

16. The sports glove of claim 14, wherein the flange member is independent distal from the attachment to the base.

17. The sports glove of claim 14, wherein the adjacent padding sections define an aperture and deflection of the plurality of finger cases exposes the aperture between the plurality of padding sections and the knuckle guard substantially fills the aperture during use of the sports glove.

18. The sports glove of claim 5, wherein the attachment between the at least one extended member and the base is flexible independent from the engagement of the base and the protection section.

* * * * *